US005706671A

United States Patent [19]

Lee et al.

[11] Patent Number: 5,706,671

[45] Date of Patent: Jan. 13, 1998

[54] COOL AIR CYCLONIC DISCHARGE SYSTEM FOR A REFRIGERATOR

[75] Inventors: Seung Bae Lee, Gwacheon; Sung Hoon Jin, Sungnam, both of Rep. of Korea

[73] Assignee: Samsung Electronics Co., Ltd., Suwon, Rep. of Korea

[21] Appl. No.: 524,429

[22] Filed: Sep. 6, 1995

[51] Int. Cl.[6] ..... F25D 17/04

[52] U.S. Cl. ..... 62/407; 62/426; 62/440

[58] Field of Search ..... 62/407, 404, 455, 62/419, 426, 440; 454/285; 415/208.1, 211.2, 414, 182.1

[56] References Cited

U.S. PATENT DOCUMENTS 2,824,429 2/1958 Zucker ..... 62/408

*Primary Examiner*—John M. Sollecito

*Attorney, Agent, or Firm*—Burns, Doane, Swecker & Mathis, L.L.P.

[57] ABSTRACT

A refrigerator includes a food storage compartment, and an evaporator for providing cold air which is to be fed to the food storage compartment by a fan. The fan discharges cold air to a cyclone member having a tangential inlet for receiving cold air, and a conical outlet for discharging the cold air at a higher velocity to the food storage compartment.

4 Claims, 7 Drawing Sheets

COOL AIR CYCLONIC DISCHARGE SYSTEM FOR A REFRIGERATOR

BACKGROUND OF THE INVENTION

This invention relates to a cool air discharge system for a refrigerator, and more particularly to a cool air discharge system for a refrigerator by which the discharging air generated from a fan is discharged into respective compartments.

A conventional cool air discharge system for a refrigerator is illustrated in FIG. 6 and 7. The refrigerator 1 normally consists of freezing and refrigerating compartments 3*a*, 3*b* separated by an intermediate partition wall 2, the former compartment 3*a* being located above the latter. The refrigerating compartment 3*b* further provides a vegetable basket 3*c* at the lower portion. On the front surface of each of the freezing and refrigerating compartments 3*a*, 3*b* doors 9*a*, 9*b* are hingedly installed. At the rear portion of the freezing compartment 3*a* a fan louver 6*a* defined as a front wall member and an evaporator cover 6*b* acting as a rear wall member are provided. Above an evaporator 4 a fan 5 operated by a fan motor 5*a* is installed. A front discharge opening 7*a* is formed at the fan louver 6*a* for discharging cool air by the fan 5. Some cool air passes the area between the fan louver 6*a* and the evaporator cover 6*b* and is directed into the refrigerating compartment 3*b* via front discharge opening 7*b* of a vertical wall 6*c* provided at the rear portion of the refrigerating compartment 3*b*. Respective cool air circulating in the freezing and refrigerating compartments 3*a*, 3*b* flows back to the evaporator 4 via the return duct 8 provided at the intermediate partition wall 2.

In the cool air discharge system, as the cool air generated from the evaporator 4 is discharged toward the fan louver 6*a* by operation of the fan 5, cool air passes the bell mouse 5*c*, as shown in FIG. 7, which is encompasses the circumferential area of the fan 5 with a curvature radius 'r'. The cool air immediately downstream of the fan has a velocity which is almost the same as that of the air passing through the fan 5, and is abruptly spread adjacent to the fan louver 6*a*. That is, in case that a diameter of the cool air stream spaced downstream from the fan 5 is assumed as 'd', the cool air at the diameter 'd', has to the velocity of the air in the fan. Therefore, the noise generated from the air flowing to the fan louver 6*a* increases in proportion to the speed of the air passing the bell mouse 5*c*. Further, part of the cool air flow, traveling to the fan louver 6*a* parallel with the motor shaft 5*b*, passes through the bell mouse 5*c*. Even so, a relative high velocity air is forced onto the fan louver 6*a* and flows back toward the fan 5 and impacts air travel in an opposite flow direction, where upon a separation of the flow stream arises. Therefore, the flow velocity of the cool air, as shown in FIG. 7, is gradually in a non-constant state as it is flowing to the fan louver 6*a* from the fan 5. Such a phenomenon is more serious to the generation of noise than the high velocity of the air which passes the fan 5 as described earlier.

On the other hand, if the separating stream flow, or the non-constant velocity flow were to travel a greater distance, the non-constant velocity flow turns into a constant velocity flow distance-by-distance end forcedly flows. Therefore so that the cool air passing through the opening 7*a* is blown to the refrigerating compartment 3*a* at a constant velocity, it is necessary to increase the distance 'Dp' between the fan louver 6*a* and the rear wall 1*w*. This results in the problem that the volume of the freezing compartment is decreased.

Moreover, the cool air circulating in compartments 3*a*, 3*b* through front discharge openings 7*a*, 7*b* at high velocity keeps the area of respective compartments adjacent to the openings 7*a*, 7*b* cold but the cool air in the area of respective compartments spaced far from the openings 7*a*, 7*b* is in a decreasing velocity, and the temperature of the cool air is gradually increased. This can decrease the cooling efficiency, thus providing another problem.

SUMMARY OF THE INVENTION

An object of the present invention is to provide a cool air discharge system for a refrigerator by which the noise of the air flowing to the fan louver can relatively be reduced so that the discharge velocity of cool air is decreased when the discharging cool air passes an air guiding member in the diffuser shape.

Another object of the present invention is to provide a cool air discharge system for a refrigerator which can increase the available volume of the freezing compartment while still holding the level of noise constant.

Still another object of the present invention is to provide a cool air discharge system for a refrigerator which can forcedly discharged cool air having a accelerating rotational velocity component, thus increasing the cooling efficiency.

SUMMARY OF THE INVENTION

According to the present invention, the cool air discharge system for a refrigerator comprises a cool air guiding member mounted adjacent to an outlet of an axial fan for discharging the cool air generated from an evaporator at a constant velocity; and a cyclone generating means for turning the constant velocity air flow through the cool air guiding member into a vertical air flow and discharging the air flow at high velocity into the compartments.

Further, the cyclone generating means comprises a cylindrical hollow body, the body having an inlet member provided tangent to the body for receiving the low velocity air flow; a cylindrical member arranged coaxially longitudinally in the body, at one end of the cylindrical member is provided a sealing plate for preventing leakage, the cylindrical member and the sealing plate are guiding the cool air passed the inlet member; and a conical member is formed as a gradual reduced surface in the cool air discharging direction and arranged at the outlet of the body, and for increasing the rotational velocity of the cool air directed to the outlet.

DESCRIPTION OF THE PREFERRED EMBODIMENTS

Figure 1:
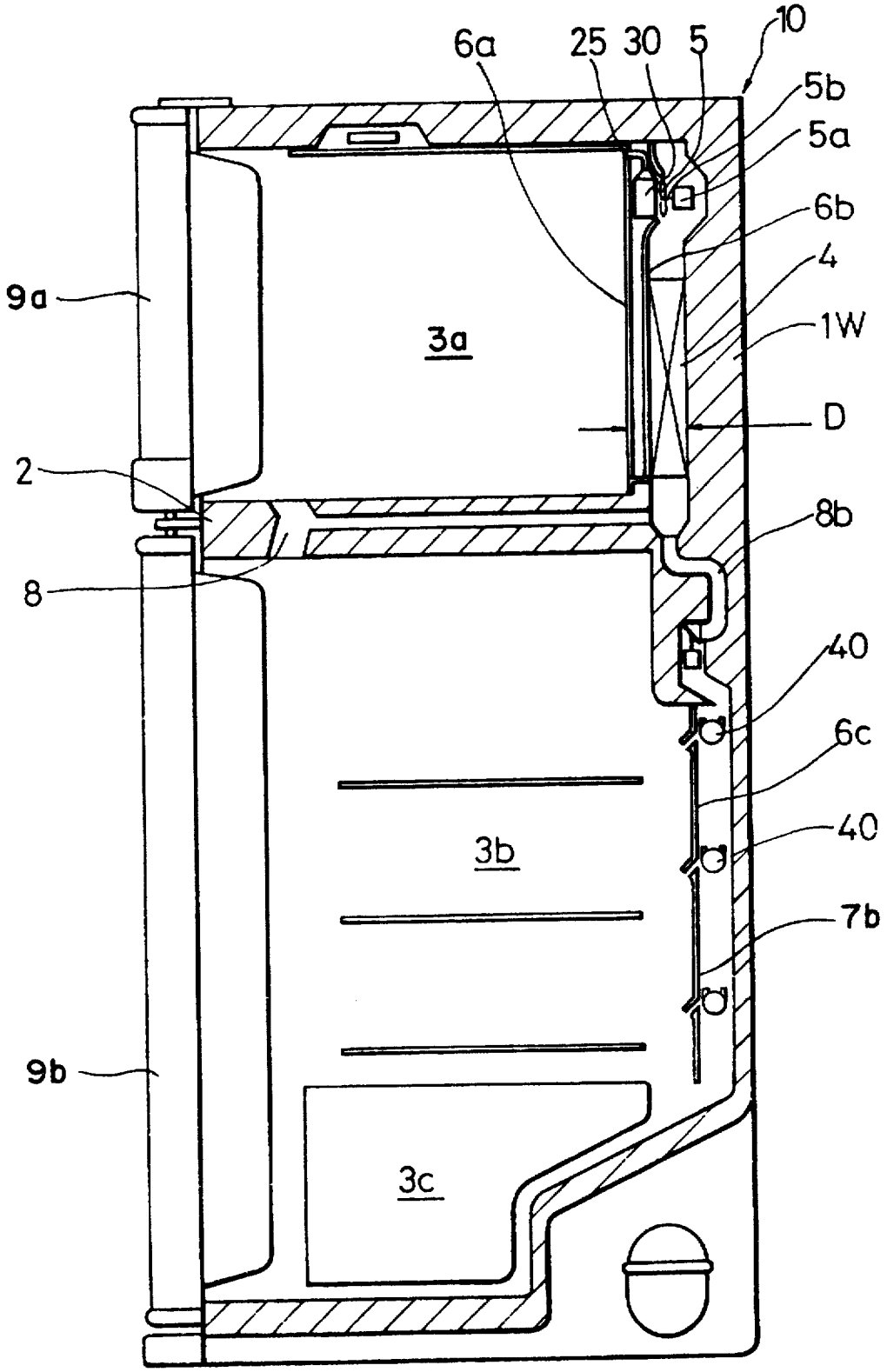
FIG. 1 is a vertical cross-sectional view through a refrigerator according to the present invention

FIG. 1 illustrates a refrigerator having a cool air discharge system according to the present invention. The refrigerator 10 normally consists of freezing and refrigerating compartments 3a, 3b separated by an intermediate partition wall 2, the former compartment a being located above the latter.

Figure 6:
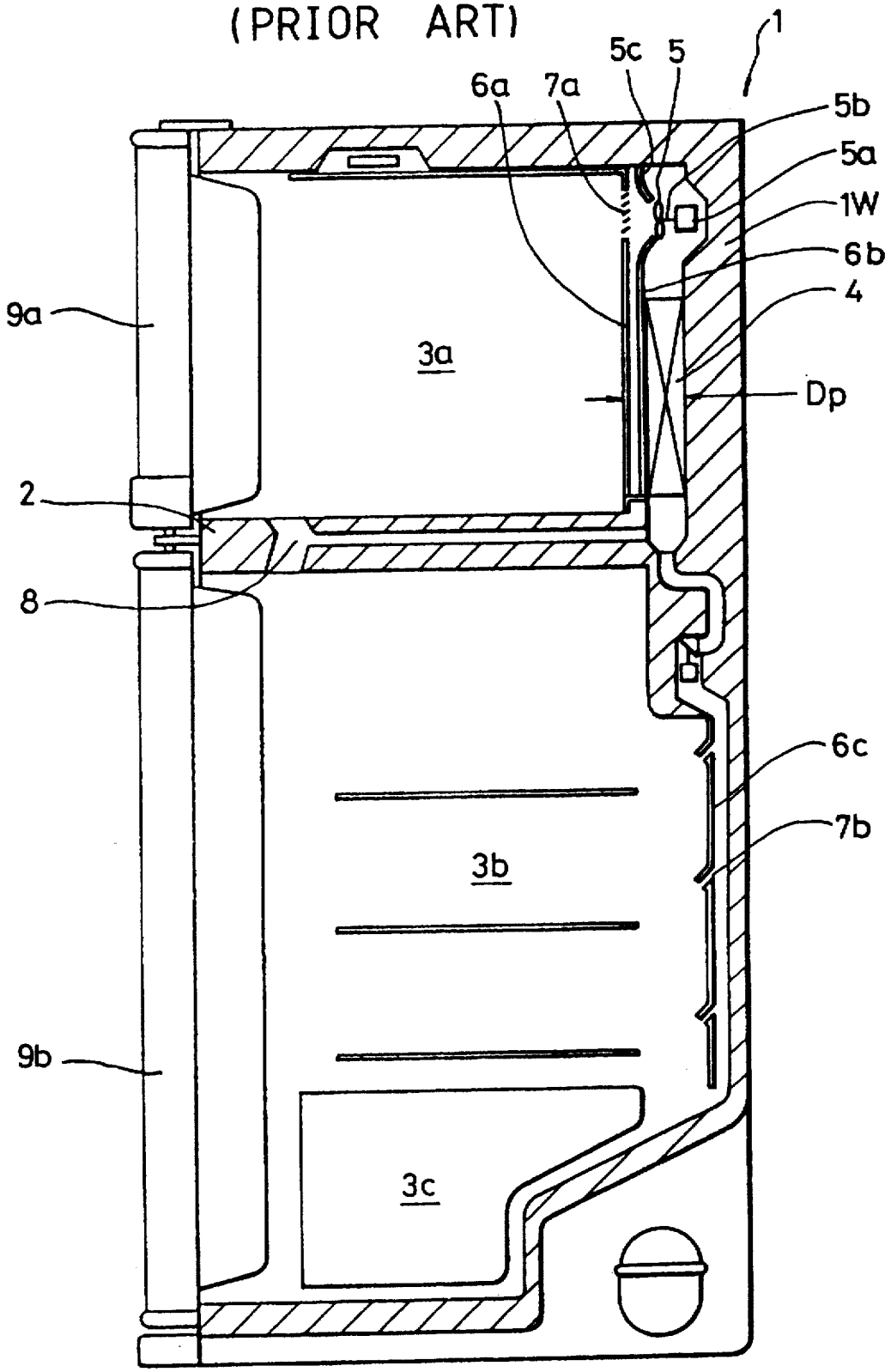
FIG. 6 (PRIOR ART)
FIG. 6 is a vertical cross-sectional view similar to FIG. 1 of a conventional refrigerator.
Figure 7:
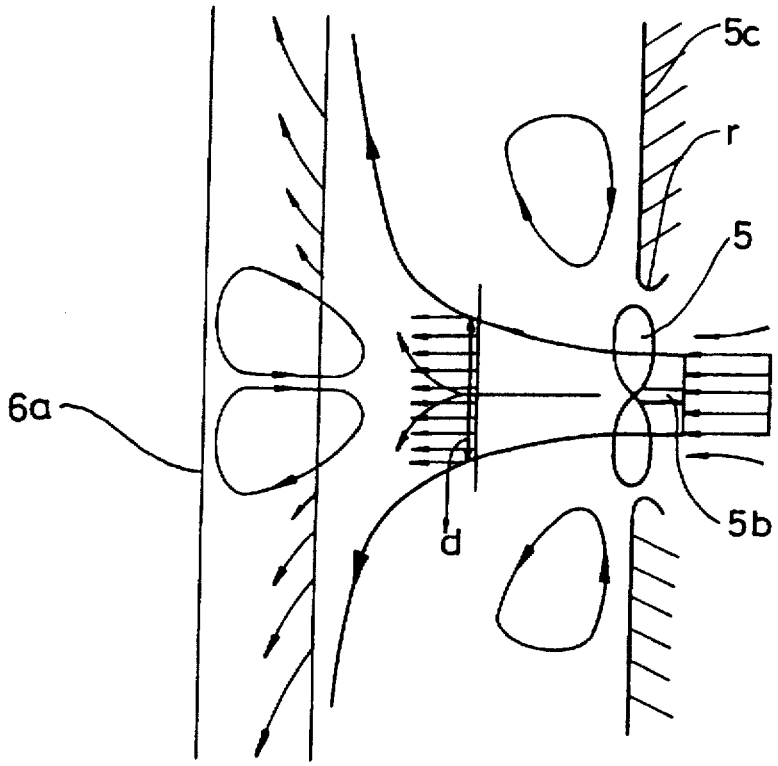
FIG. 7 (PRIOR ART)
FIG. 7 is an enlarged vertical cross-sectional view of the cool air discharge system of FIG. 6, showing a two-dimensional flow velocity distribution.

The same component parts as those in the present embodiment are designated by the same reference numerals as in the conventional embodiment of FIGS. 6–7, so a detailed description of those parts will be omitted.

The cool air discharge system comprises a cool air guiding member 50 (FIGS. 2–3) mounted adjacent to an outlet of an axial fan 5 at the rear portion of the freezing compartment 3a. Further, the cool air discharge system comprises a cyclone generating means 30 (FIG. 2,4) for the freezing compartment 3a mounted at the front portion of the cool air guiding member 50. Furthermore, the cool air discharge system comprises a cyclone generating means 40 (FIG. 1,5) for the refrigerating compartment 3b mounted at the rear portion of the refrigerating compartment 3b.

Figure 2:
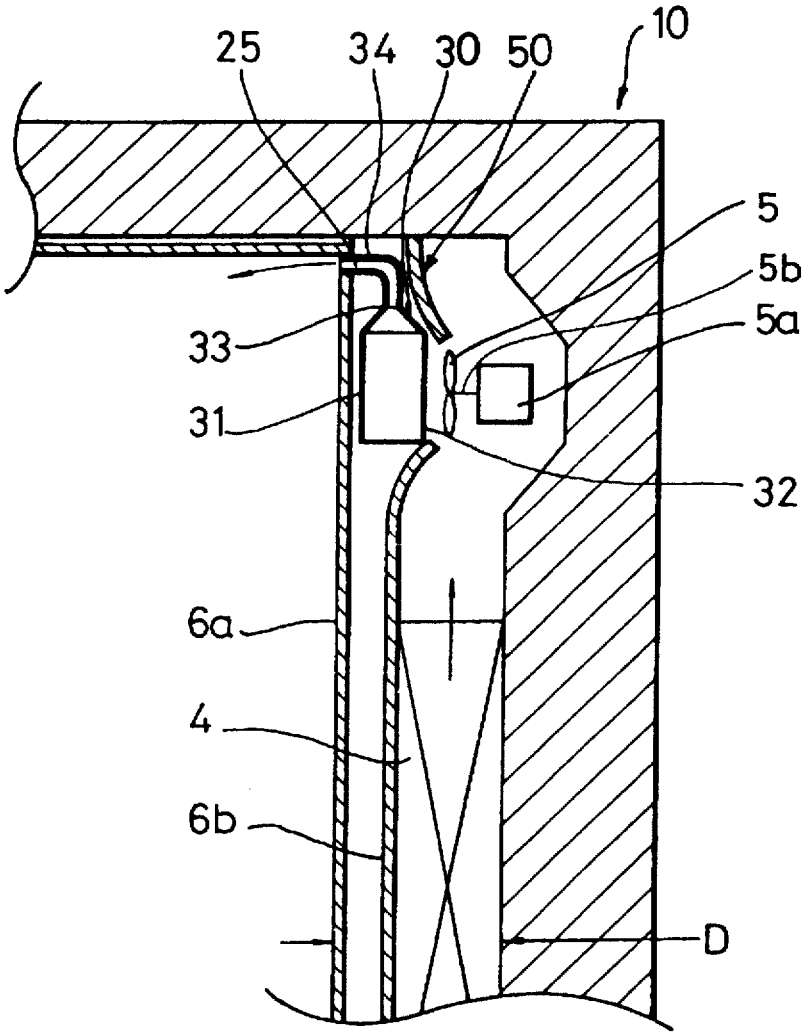
FIG. 2 is an enlarged vertical cross-sectional view of a portion of the refrigeration adopting the cool air discharge system of FIG. 1.

In FIG. 2, the cool air guiding member 50 is shown as formed at the upper portion, i.e. adjoining the fan 5 of the evaporator cover 6b. The cool air guiding member 50 is formed in a diffuser shape with a larger curvature radius 'R'. The incoming portion of the guiding member 50 is narrow and the outgoing portion thereof is wide. That is, the guiding member 50 is configurated as a truncated cone flared toward the cyclone generating means 30

Since, at a distance from the fan 5, the diameter 'D' of the cool air discharged stream in the guiding member 50 is larger than the diameter 'd' of the bell mouse in the prior art, the speed of cool air passing through the guiding member 50 slows more is slower than air passing through the bell mouse in the prior art. The noise generated from the air striking the fan louver 6a is proportional to the speed of the air passing through the guiding member 50, whereby less noise is generated by the present invention than by the prior art.

Figure 3:
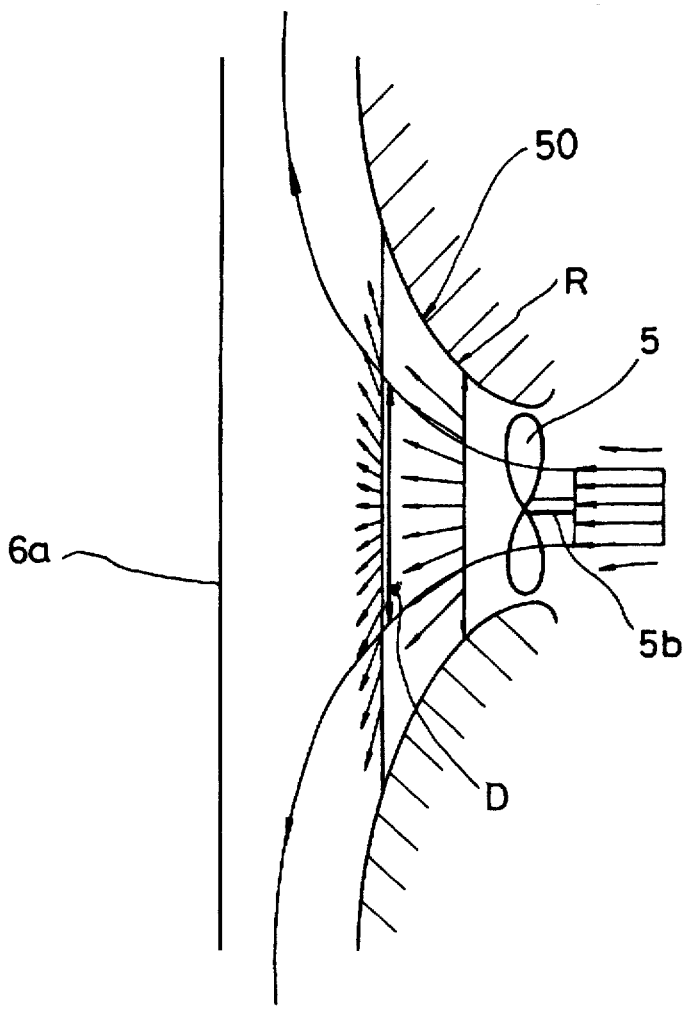
FIG. 3 is an enlarged vertical cross-sectional view of the cool air discharge system of FIG. 1, showing a two-dimensional flow velocity distribution.

Therefore, the air which is directed to the cyclone generating member 30 along the axis of the motor shaft 5b is at a low velocity. However, the velocity of the air departing from the periphery of the shaft 5b is the same as that of the air adjacent to the shaft 5b (FIG. 3).

Figure 4:
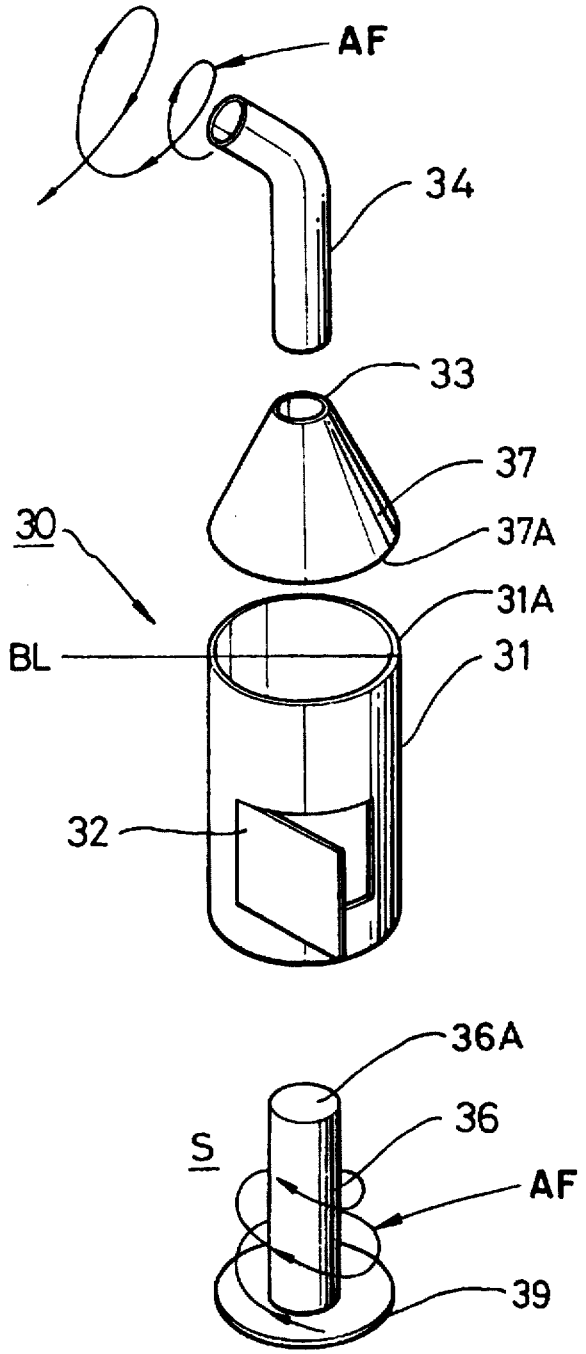
FIG. 4 is a perspective view of an exploded cyclone generating means for a freezing compartment.

FIG. 4 shows the cyclone generating means 30 for a freezing compartment 3a. The cyclone generating means 30 comprises a cylindrical hollow body 31, and a guiding member having a cylindrical portion 36 and a conical portion 37. The body 31 comprises a planar inlet member 32 formed tangent to the wall body 31 for receiving the low velocity air flow.

The cylindrical portion 36 is vertically mounted on the lower plate 39 covering the lower opening of the cylindrical hollow body 31. The cylindrical portion 36 is arranged coaxially longitudinally in the body 31 so as to create a space S between the wall of the body 31 and the cylindrical portion 36. The air travels the space S at a constant velocity. Simultaneously, the upper edge 36A of the cylindrical portion 36 lies on a line BL defined by the lower edge 37A of the conical portion 37 and the upper edge 31A of the body 31. The cool air circulating around the cylindrical portion 36 reaches the conical portion 37 at a constant velocity. The conical portion 37 is placed at the upper edge 31A of the body 31 opposite to the lower plate 39. The conical portion 37 is tapered toward the outlet 33.

As the cool air entering the conical portion 37 from the space S flows toward the outlet 33, the rotational radius of the air stream AF (see FIG. 4) is gradually decreased whilst the rotational (swirling) velocity is increased little by little. Accordingly, the air enters into the guide duct 34 at a high velocity, which is generated by its passing through the conical portion 37.

Figure 5:
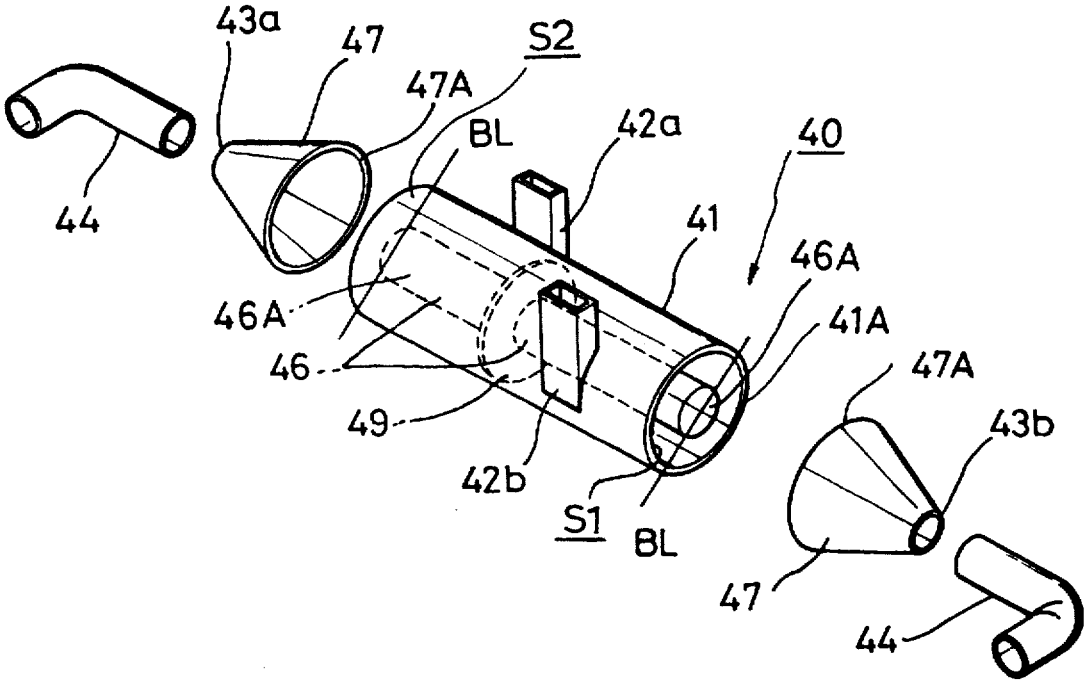
FIG. 5 is a perspective view of an exploded cyclone generating means for a refrigerating compartment.

Next, the cyclone generating means 40 for a refrigerating compartment 3b is shown in FIG. 5. The cyclone generating means 40 comprises a cylindrical hollow body 41, and a guiding member having a cylindrical portion 46 and a conical portion 47, which is similar to FIG. 4. At the middle portion of the body 41, a partition plate 49 is provided for separating the body 41 into two parts. Further, the body 41 comprises respective planar inlet members 42a, 42b formed tangent to the wall body 41 for receiving the low velocity air flow.

The cylindrical portion 46 is coaxially longitudinally mounted on the partition plate 49 with respect to the body 46. Therefore, the spaces S1,S2 are created between the wall of the body 41 and the cylindrical portion 46. The air traverses the spaces S1,S2 at a constant velocity. Simultaneously, the upper edges 46A of respective cylindrical portions 46 lie on a line BL defined by the lower edge 47A of respective conical portions 47 and both edges 41A of the body 41. The cool air which circulates around respective cylindrical portions 46 reachers respective conical portions 47 at a constant velocity.

As the cool air which enters respective conical portions 47 via the spaces S1,S2 flows toward respective outlets 43a, 43b, the rotational radius of the air stream is gradually decreased whilst the rotational velocity is increased little by little.

Accordingly, the air enters into respective guide ducts 44 at a high velocity, which is generated by passing through respective conical portions 47.

In this embodiment, since respective inlet members 42a, 42b are a provided on circumferentially outer surface of the body 41 in the opposite location, respective feeding directions of the cool air which flow through respective spaces 'S1 and S2' can be different. Alternatively, if respective inlet members 42a, 42b are provided on the outer surface of the body 41 at the same circumferential, but axially spaced, location, respective feeding directions of the cool air which flow through respective spaces 'S1 and S2' can be the same.

The cool air discharge system for a refrigerator, and built as described, operates as follows.

The cool air passing the evaporator 4 is directed to the diffuser shaped guiding member 50. The air discharged from the remote area of the shaft 5b, the periphery of the fan 5 flows along the enlarging surface of the guiding member 50. The velocity of the air is same as that of the air which is passed along the area adjacent to the shaft 5b (FIG. 3). That is, since the diameter 'D' of the cool air passage of the guiding member 50 is relatively larger than that of the bell mouse in the prior art, the cool air passing through the guiding member 50 is slower. The relative slow cool air becomes cool air having a constant velocity at a point not far from the fan 5. The distance Da between the fan louver 6a and the rear wall 1w (FIG. 2) can be short. The cool air having a constant flow velocity is fed to the cyclone generating means 30. The relative constant velocity air is fed into the body 31 by means of the planar inlet member 32. The air passes up rotatably through the space S along the cylindrical portion 36, and finally reaches the conical portion 37. As the air flows through the conical portion 37 rotation element of the rotation element of velocity is increased, and the cool air having high velocity flows into the guide duct 34. Thus, cool air having increased rotating velocity is directed into the refrigerating compartment 3a through the front discharge opening 25.

In contrast, part of the cool air generated from the evaporator is directed to the cyclone generating means 40 for the refrigerating compartment through the duct 8b which is formed in the rear wall 1w. The cool air, which flows into the body 41 through the left inlet member 42a, is directed to the left portion of the body 41, while the cool air, which flows into the body 41 through the right inlet member 42b, is directed to the right portion of the body 41. Subsequently, the air which traverses respective conical portions 47 becomes a high velocity air, and flows into the refrigerating compartment through the guide duct 44.

The cool air circulating in freezing and refrigerating compartments 3a, 3b flows back to the evaporator 4 via the return duct 8 provided at the intermediate partition wall 2.

In the present invention, the air guiding member formed as a gradual enlarging diffuser is disposed at the outlet of the fan so that the velocity of the discharging cool air is constant. Thus, noise caused by the operation of the fan is reduced. Further, since the stream of the discharging air is maintained at a constant velocity, the distance between the fan louver and the rear wall can be decreased, thereby increasing the effective volume of the compartment.

Furthermore, because the swirling cool air having a constant velocity is turned into cool air having a high velocity and subsequently is discharged into respective compartments, the storage efficiency of food-stuffs is increased owing to the active circulation of the cool air.

What is claimed is:

1. A refrigerator comprising:

a food storage compartment;

an evaporator for providing cool air;

a fan for discharging cool air from the evaporator and directing that air toward the food storage compartment; and a cyclone member disposed in a path of cool air discharged from the fan for receiving the discharged air and increasing a velocity thereof as the discharged air flows toward an outlet of the cyclone member, the outlet of the cyclone arranged to direct the increased velocity air to the food storage compartment, the cyclone member comprising:

a cylindrical chamber having a generally tangential inlet for receiving the discharged cool air, and a conical chamber disposed at an end of the cylindrical chamber opposite the inlet, the conical chamber having an outlet and being of progressively reduced cross section toward the outlet.

2. The refrigerator according to claim 1 wherein the cyclone member further includes a cylindrical member extending within the cylindrical chamber along a center axis thereof, with the cool air flowing along the outside of the cylindrical member.

3. A refrigerator comprising:

a food storage compartment;

an evaporator for providing cool air; a fan for discharging cool air from the evaporator and directing that air toward the food storage compartment; and a cyclone member disposed in a path of cool air discharged from the fan for receiving the discharged air and increasing a velocity thereof as the discharged air flows toward an outlet of the cyclone member, the outlet of the cyclone arranged to direct the increased velocity air to the food storage compartment, the cyclone member comprising:

a cylindrical chamber having a divider extending across a cross section thereof to divide the chamber into first and second sections, first and second tangential inlets communicating with the first and second chamber sections for receiving respective portions of the discharged cool air, respectively, and second conical chambers disposed at respective opposite ends of the cylindrical chamber, each conical chamber tapering toward an outlet thereof, the outlet opening into the food storage compartment.

4. The refrigerator according to claim 3 wherein the cyclone member further includes a cylindrical member extending within the cylindrical chamber along a center axis thereof, with the cool air flowing along the outside of the cylindrical member.

* * * * *